US009174457B1

(12) United States Patent
Aihara et al.

(10) Patent No.: US 9,174,457 B1
(45) Date of Patent: Nov. 3, 2015

(54) PRINTING APPARATUS

(71) Applicants: Yuichi Aihara, Yamanashi-ken (JP); Toshiro Fujimoto, Yamanashi-ken (JP)

(72) Inventors: Yuichi Aihara, Yamanashi-ken (JP); Toshiro Fujimoto, Yamanashi-ken (JP)

(73) Assignee: NISCA CORPORATION, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 14/719,719

(22) Filed: May 22, 2015

(30) Foreign Application Priority Data

May 23, 2014 (JP) ..... 2014-106902

(51) Int. Cl.
*B41J 33/54* (2006.01)
*B41J 2/325* (2006.01)
*B41J 17/02* (2006.01)

(52) U.S. Cl.
CPC *B41J 2/325* (2013.01); *B41J 33/54* (2013.01); *B41J 17/02* (2013.01)

(58) Field of Classification Search
USPC ..... 347/213, 215, 217
See application file for complete search history.

(56) References Cited

U.S. PATENT DOCUMENTS 4,675,698 A * 6/1987 Tsutsumi ..... 347/217
4,924,240 A * 5/1990 Herbert et al. ..... 347/217

FOREIGN PATENT DOCUMENTS

JP 2010-269459 A 12/2010

OTHER PUBLICATIONS

Machine-generated translation of JP 2010-269459, published on Dec. 2010.*

* cited by examiner

*Primary Examiner* — Huan Tran
(74) *Attorney, Agent, or Firm* — Manabu Kanesaka

(57) ABSTRACT

To provide a printing apparatus that does not degrade the printing quality even when reciprocating shifts of a film-shaped medium are continued, an ink ribbon 41 that is the film-shaped medium is laid between a supply spool 43 and a wind-up spool 44 with regions used in printing on a single printing medium formed continuously in the longitudinal direction. A counter counts the number of times an unused region in the ink ribbon 41 located in a predetermined position between the supply spool 43 and the wind-up spool 44 reciprocates and shifts between the supply spool 43 and the wind-up spool 44, and when the number of times reaches the predetermined number, the wind-up spool 44 is driven to shift the region in the wind-up direction from the printing position.

6 Claims, 5 Drawing Sheets

| No. | OPERATION | | REGION | | | | | | | | | | | | | | | |
|---|---|---|---|---|---|---|---|---|---|---|---|---|---|---|---|---|---|---|
| | | | * | 1 | 2 | 3 | 4 | 5 | 6 | 7 | 8 | 9 | 10 | 11 | 12 | 13 | 14 | 15 |
| | | INITIAL VALUE | | 0 | 0 | 0 | 0 | | | | | | | | | | | |
| 1 | INITIALIZATION | INITIALIZATION START | | 1 | 1 | 1 | 0 | | | | | | | | | | | |
| | | INITIALIZATION END | | 1 | 1 | 1 | 0 | | | | | | | | | | | |
| 2 | INITIALIZATION | INITIALIZATION START | | 2 | 2 | 2 | 0 | | | | | | | | | | | |
| | | INITIALIZATION END | | 2 | 2 | 2 | 0 | | | | | | | | | | | |
| 3 | INITIALIZATION | INITIALIZATION START | | 3 | 3 | 3 | 1 | | | | | | | | | | | |
| | | INITIALIZATION END | | X | X | X | 1 | 0 | 0 | 0 | | | | | | | | |
| 4 | PRINTING | PRINTING START | | | | | 2 | 1 | 0 | 0 | | | | | | | | |
| | | PRINTING END | | | | | X | 1 | 0 | 0 | 0 | | | | | | | |
| 5 | INITIALIZATION | INITIALIZATION START | | | | | | 2 | 1 | 1 | 0 | | | | | | | |
| | | INITIALIZATION END | | | | | | 2 | 1 | 1 | 0 | | | | | | | |
| 6 | INITIALIZATION | INITIALIZATION START | | | | | | 3 | 2 | 2 | 1 | | | | | | | |
| | | INITIALIZATION END | | | | | | X | X | X | 1 | 0 | 0 | 0 | | | | |
| 7 | INITIALIZATION | INITIALIZATION START | | | | | | | | | 2 | 1 | 1 | 0 | | | | |
| | | INITIALIZATION END | | | | | | | | | 2 | 1 | 1 | 0 | | | | |
| 8 | PRINTING | PRINTING START | | | | | | | | | 3 | 2 | 1 | 0 | | | | |
| | | PRINTING END | | | | | | | | | X | 2 | 1 | 0 | 0 | | | |
| 9 | INITIALIZATION | INITIALIZATION START | | | | | | | | | | 3 | 2 | 1 | 1 | | | |
| | | INITIALIZATION END | | | | | | | | | | | | | 1 | 0 | 0 | 0 |

FIG. 3

| No. | OPERATION | | REGION | | | | | | | | | | | | | | | | |
|---|---|---|---|---|---|---|---|---|---|---|---|---|---|---|---|---|---|---|---|
| | | | * | 1 | 2 | 3 | 4 | 5 | 6 | 7 | 8 | 9 | 10 | 11 | 12 | 13 | 14 | 15 |
| | | INITIAL VALUE | | 0 | 0 | 0 | 0 | | | | | | | | | | | |
| 1 | INITIALIZATION | INITIALIZATION START | | 1 | 1 | 1 | 0 | | | | | | | | | | | |
| | | INITIALIZATION END | | 1 | 1 | 1 | 0 | | | | | | | | | | | |
| 2 | INITIALIZATION | INITIALIZATION START | | 2 | 2 | 2 | 0 | | | | | | | | | | | |
| | | INITIALIZATION END | | 2 | 2 | 2 | 0 | | | | | | | | | | | |
| 3 | INITIALIZATION | INITIALIZATION START | | 3 | 3 | 3 | 1 | | | | | | | | | | | |
| | | INITIALIZATION END | | X | X | X | 1 | 0 | 0 | 0 | | | | | | | | |
| 4 | PRINTING | PRINTING START | | | | | 2 | 1 | 0 | 0 | | | | | | | | |
| | | PRINTING END | | | | | X | 1 | 0 | 0 | 0 | | | | | | | |
| 5 | INITIALIZATION | INITIALIZATION START | | | | | | 2 | 1 | 1 | 0 | | | | | | | |
| | | INITIALIZATION END | | | | | | 2 | 1 | 1 | 0 | | | | | | | |
| 6 | INITIALIZATION | INITIALIZATION START | | | | | | 3 | 2 | 2 | 1 | | | | | | | |
| | | INITIALIZATION END | | | | | | X | X | X | 1 | 0 | 0 | 0 | | | | |
| 7 | INITIALIZATION | INITIALIZATION START | | | | | | | | | 2 | 1 | 1 | 0 | | | | |
| | | INITIALIZATION END | | | | | | | | | 2 | 1 | 1 | 0 | | | | |
| 8 | PRINTING | PRINTING START | | | | | | | | | 3 | 2 | 1 | 0 | | | | |
| | | PRINTING END | | | | | | | | | X | 2 | 1 | 0 | 0 | | | |
| 9 | INITIALIZATION | INITIALIZATION START | | | | | | | | | | 3 | 2 | 1 | 1 | | | |
| | | INITIALIZATION END | | | | | | | | | | | | | 1 | 0 | 0 | 0 |

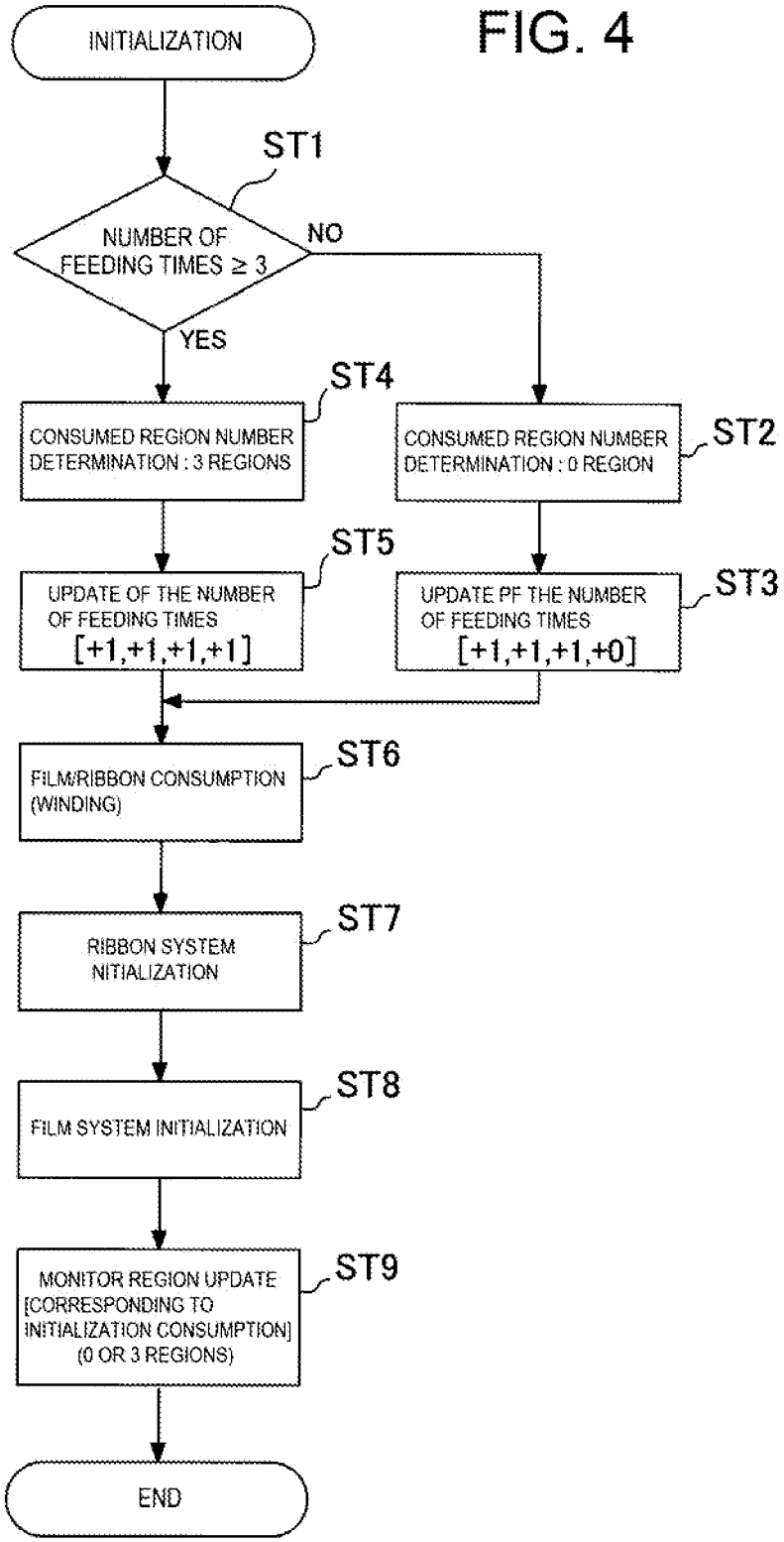
FIG. 4
INITIALIZATION
ST1
NUMBER OF FEEDING TIMES ≥ 3
NO
YES
ST4
CONSUMED REGION NUMBER DETERMINATION : 3 REGIONS
CONSUMED REGION NUMBER DETERMINATION : 0 REGION
ST2
ST5
UPDATE OF THE NUMBER OF FEEDING TIMES [+1,+1,+1,+1]
UPDATE PF THE NUMBER OF FEEDING TIMES [+1,+1,+1,+0]
ST3
FILM/RIBBON CONSUMPTION (WINDING)
ST6
RIBBON SYSTEM NITIALIZATION
ST7
FILM SYSTEM INITIALIZATION
ST8
MONITOR REGION UPDATE [CORRESPONDING TO INITIALIZATION CONSUMPTION] (0 OR 3 REGIONS)
ST9
END

PRINTING APPARATUS

TECHNICAL FIELD

The present invention relates to a printing apparatus that prints an image on a recording medium such as a card using a film-shaped medium.

BACKGROUND ART

As a printing apparatus that forms an image such as a photograph of face and character information on a recording medium such as thick paper and plastic card, an apparatus has been known in which an image is formed once on a film-shaped transfer medium and the image formed on the transfer medium is printed and transferred onto a recording medium.

In this type of printing apparatus, an image is first thermally transferred (first transfer) onto a roll-shaped transfer film using a roll-shaped ink ribbon in which ink of a single or a plurality of colors is applied at certain intervals each of which corresponds to a card width of the recording medium, and next, the image of the transfer film is thermally transferred (second transfer) to the recording medium.

The ink ribbon and transfer film (hereinafter, these are collectively referred to as "film-shaped medium") formed in the shape of a roll are stored in cassette cases in a state in which the medium is wound around a supply spool and a wind-up spool while being laid between both spools. Accordingly, unless the film-shaped medium shifts in the same direction without causing an error (deviation) from the direction in which the medium is fed out of the supply spool, it is not possible to form an image facing a printing surface of the recording medium to degrade printing quality.

When the film-shaped medium is the ink ribbon, a surface of the film that is a substrate of the ink ribbon is coated with sublimation ink, and the printing apparatus pulls an unused portion of the ink on the film out of the supply spool to nip with a thermal head and a platen roller in a state of overlapping the transfer film, and thereby sublimates the ink to the surface of the transfer film to print the image. However, the ink ribbon is not always transported in the pull-out direction, and is sometimes rewound in the direction of winding around the supply spool. For example, in a printing apparatus that prints selectively on two types of recording media of normal size and half size, an apparatus is known where in printing on the recording medium of the half size, since a half of an ink coat region of the ink ribbon used in one printing is wound with the ink unused, in next printing operation of the half size, the region with the ink unused portion is rewound to a transfer position to the transfer film and is used (see Patent Document 1).

However, when a rewound amount is large in rewinding the ink ribbon to use, a printing wrinkle tends to occur in printing due to winding fluctuations and the like. Therefore, in Patent Document 1, in the case of requiring rewinding with a certain amount or more, rewinding is not performed even in printing operation of the half size, and printing is performed with a portion of the ink ribbon located in a transfer position at this time to the transfer film.

PRIOR ART DOCUMENT

Patent Document

[Patent Document 1] Japanese Patent Application Publication No. 2010-269459

DISCLOSURE OF INVENTION

Problems to be Solved by the Invention

On the other hand, at the time of power-on, replacement of the ink ribbon, check, or reset operation due to operation of a reset switch or the like, the printing apparatus performs rewinding and winding of each of film-shaped media formed in the shape of a roll to detect their types and the like, and performs initialization operation (initialize) such as the so-called feeding to set a region with the ink unused in a printing position. Further, also at the time of printing operation, before starting, the apparatus performs printing after performing the feeding by rewinding and winding the film-shaped medium.

However, in the film-shaped medium, when the medium is shifted by winding with the wind-up spool, tensions applied to the upper side and lower side in the longitudinal direction of the film in shifting are strictly not constant due to the structure of a transport mechanism, fluctuations of each film and the like, and the medium is not wound in a state in which a subsequent portion accurately overlaps with a portion that is already wound as a state of being first wound around the supply spool. Particularly, when the film-shaped medium is the ink ribbon, since a difference occurs in the amount of ink consumed on the surface corresponding to the pattern of the image, asperities arise on the surface of the used film, the thickness is not uniform, and the medium is wound in a further nonuniform state.

Then, when the film-shaped medium is wound around the wind-up spool in a nonuniform state, the film-shaped medium is fed from the wind-up spool while being skewed in rewinding the medium, and this posture is a state of deviating from the travel direction in transport shift that is the so-called skewed state.

Therefore, when the film-shaped medium is rewound and wound repeatedly many times in operation of initialization before printing operation, error amounts of deviation due to the skew are accumulated, the film-shaped medium does thereby not face a printing target portion, and therefore, the printing quality significantly degrades. Such a malfunction often occurs in a printing apparatus with a low use frequency of printing even when power is supplied, because the reciprocating shift by rewinding and winding in initialization is repeated frequently.

In view of the above-mentioned issue, it is an object of the present invention to provide a printing apparatus that does not degrade the printing quality even when reciprocating shifts of a film-shaped medium are continued.

Means for Solving the Problem

Therefore, the present invention provides a printing apparatus which performs printing using a film-shaped medium formed in the shape of a roll where regions used in printing on a single recording medium are continued in the longitudinal direction, which is provided with a supply section around which a portion of printing unused regions of the film-shaped medium is wound, a wind-up section around which a portion of printing used regions of the film-shaped medium is wound, and a detection section that detects the number of feeding times that the printing unused region located in a predetermined position between the supply section and the wind-up section reciprocates and shifts between the supply section and the wind-up section, and which is characterized by driving the wind-up section when the number of feeding times reaches a predetermined number to shift the printing unused region in a wind-up direction from the printing position.

Herein, when reciprocating shifts of the printing unused region reach the predetermined number of times, the region and at least one of the regions continued to the region on the supply section side may be shifted concurrently in the wind-up direction. By thus performing excessive winding, since the distance for the film-shaped medium to shift for winding is increased, the skew is corrected.

Further, a monitor region may be set on the printing unused region located in the printing position and at least one of the regions or more continued to the region on the supply section side to shift the monitor region, where it is detected by the detection section that the number of feeding times reaches the predetermined number, in the wind-up direction.

At this point, when the detection section detects that the number of feeding times of the monitor region located in the printing position reaches the predetermined number, a beforehand determined number of monitor regions continued to the monitor region are shifted in the wind-up direction irrespective of whether or not the number of feeding times of each of the regions reaches the predetermined number.

In addition, the film-shaped medium is an ink ribbon coated with ink used in printing on a single recording medium for each of the regions, or a transfer film to print an image on the recording medium after printing the image on the region with the ink applied to the ink ribbon.

Advantageous Effect of the Invention

In the printing apparatus according to the present invention, stable printing quality is ensured by not performing printing on a portion where skew occurs by repeating reciprocating shifts due to winding and rewinding of the film-shaped medium in initialization processing at the time of power-on and prior operation in printing.

BRIEF DESCRIPTION OF DRAWINGS

FIG. 3 shows a matrix schematically illustrating an operation example in which printing is not performed on a portion with an error due to skew of a film-shaped medium being large;

FIG. 4 shows a flowchart in initializing the printing apparatus; and

BEST MODE FOR CARRYING OUT THE INVENTION

Figure 1:
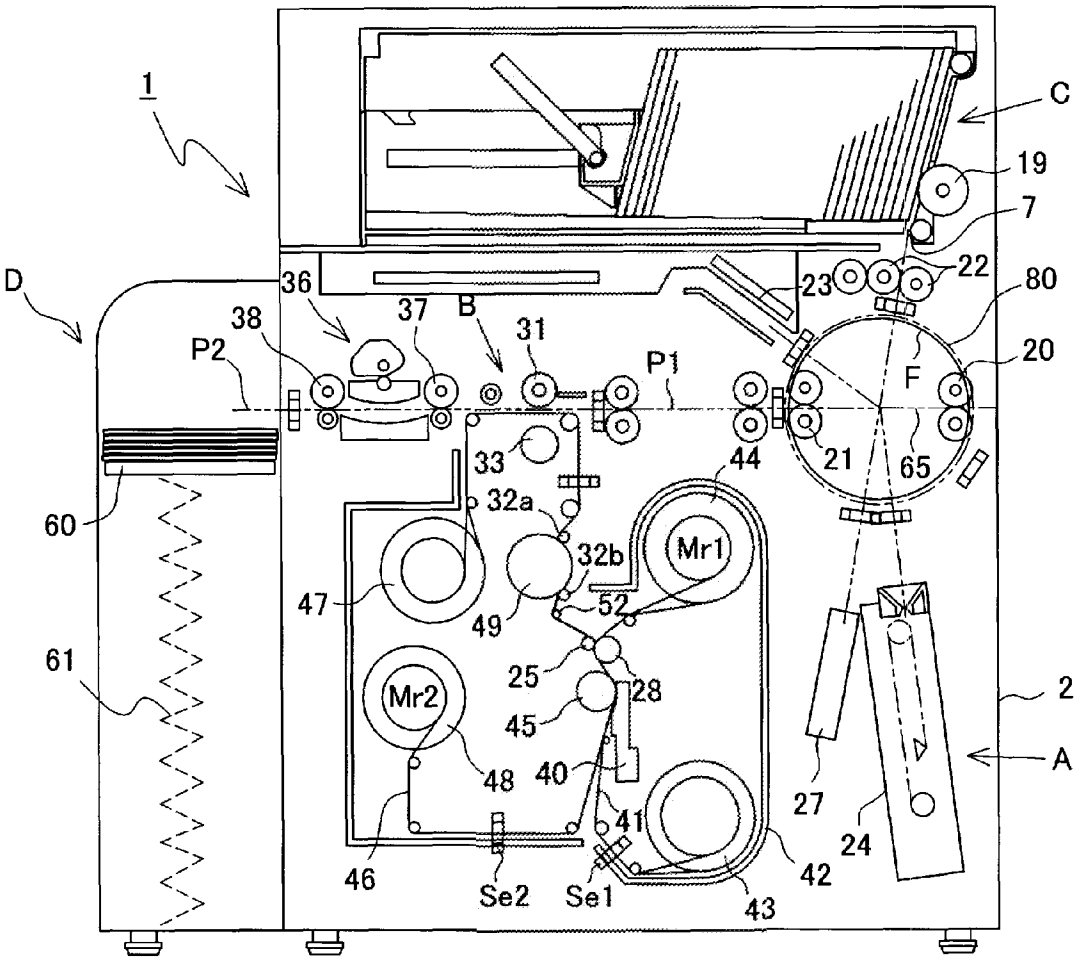
FIG. 1 illustrates an entire configuration view of one Embodiment of a printing apparatus according to the present invention.

The present invention will specifically be described based on a preferred Embodiment. FIG. 1 illustrates the entire configuration of a printing apparatus 1 according to the present invention. The printing apparatus 1 is to record information on a recording medium (hereinafter, referred to as "card") such as ID cards for various kinds of identification and credit cards for business transactions, and in a housing 2 are provided an information recording section A, image formation section B, media storage section C, and storage section D.

The information recording section A is comprised of a non-contact type IC recording section 23, magnetic recording section 24, and contact type IC recording section 27.

The media storage section Caligns a plurality of cards in a standing posture to store, is provided at its front end with a separation opening 7, feeds and supplies sequentially starting with the card in the front row with a pickup roller 19.

The fed card is first sent to a reverse unit F by rotation of carry-in rollers 22. The reverse unit F is comprised of a rotating frame 80 bearing-supported by the apparatus frame 2 to be turnable, and two roller pairs 20 and 21 rotatably supported on the frame. The above-mentioned non-contact type IC recording section 23, magnetic recording section 24 and contact type IC recording section 27 are disposed in the outer region of the rotating reverse unit F. Then, a medium carry-in path 65 formed by the roller pairs 20 and 21 is capable of connecting to any of the information recording sections by rotation of the reverse unit F, and on the card, it is possible to magnetically or electrically write predetermined data in the recording sections.

The image formation section B is to form an image such as a photograph of face and text data on one surface or both surfaces of the card, and a medium transport path P1 for carrying the card is provided on an extension of the medium carry-in path 65. Further, the image formation section B is provided with a first transfer section that first prints an image on a transfer film 46 laid between a wind-up spool 48 which rotates by driving of a motor Mr2 and a supply spool 47, using a thermal head 40 and platen roller 45, and a second transfer section that subsequently prints the image printed on the transfer film 46 on the surface of the card located in the medium transport path P1, using the heat roller 33 and platen roller 31.

A film transport roller 49 is a drive roller that nips the transfer film 46 with pinch rollers 32*a* and 32*b* disposed on the periphery thereof to carry, and by controlling driving of the roller 49, transport amount and transport halt position of the transfer film 46 are determined. The pinch rollers 32*a* and 32*b* are configured to be able to move and retract to/from the film transport roller 49, and wind the transfer film 46 around the film transport roller 49 by moving to the film transport roller 49 to come into press-contact.

On the downstream side of the image formation section B is provided a medium transport path P2 to transport with a pair of transport rollers 37 and 38, and the printed card is guided to the storage section D through the medium transport path P2 while a decurl mechanism 36 corrects a curl occurring due to thermal transfer. A stacker 60 that stores cards of the storage section D is configured to shift in the vertical direction with an up-and-down mechanism 61.

An ink ribbon 41 is stored in a cassette 42, a supply spool 43 and wind-up spool 44 are stored in the cassette 42, and the wind-up spool 44 is driven by a motor Mn1.

Figure 2:
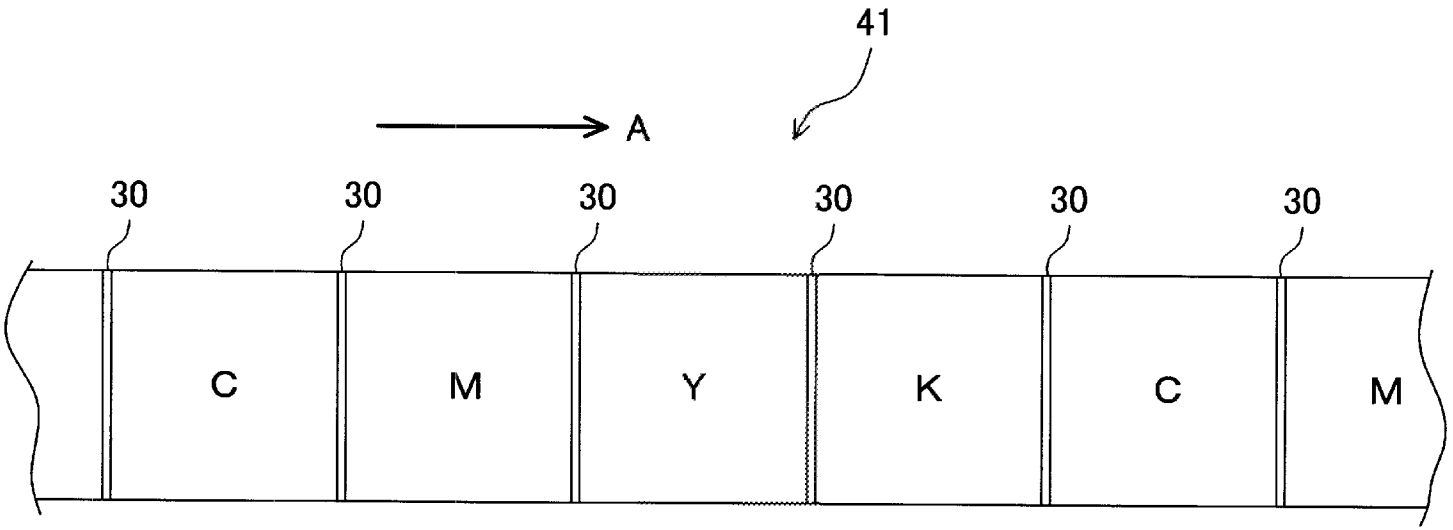
FIG. 2 is a schematic diagram illustrating a configuration of an ink ribbon.

As shown in FIG. 2, the ink ribbon 41 used in this Embodiment has four kinds of panels in which a base film made of materials such as synthetic resin in the shape of a band is coated with each sublimation ink of Cyan (C), Magenta (M), Yellow (Y), and Black (K) along a shift direction shown by the arrow. Then, one panel is set for the same length as the dimension in the longitudinal direction of a single card, and in transferring an image to print on a single card to the transfer film 46, these four kinds of panels are thermally fused to the transfer film 46 sequentially. Accordingly, four panels of C, M, Y, K form a single region used in printing of a single card, and in the ink ribbon 41, this region is repeatedly disposed sequentially along the longitudinal direction of the base film. In addition, when the printing apparatus 1 performs printing with a single color, one panel of the ink ribbon 41 is a single region.

Then, at the beginning of each of panels C, M, Y, K of the ink ribbon 41 is provided a detection mark 30 that is detected by a sensor Se1 to identify the beginning of each of the panels. Particularly, the detection mark 30 at the beginning of the C panel is recognized as the beginning of the region. The sensor Se1 is disposed in a position spaced a predetermined distance away from the printing position by the thermal head 40 and platen roller 45, and this distance is provided, for example, in the relationship that the sensor Se1 detects the detection mark 30 of the C panel of another region in a subsequent stage with the predetermined number of regions located when the beginning of the C panel of some region is in the printing position.

Further, although not shown, the transfer film 46 is provided with detection marks detected by a sensor Se2 at intervals that are the same dimension in the longitudinal direction of the card. In the case of the transfer film 46, a portion between adjacent detection marks is a single region used in printing of a single card.

The printing apparatus 1 overlaps the ink ribbon 41 and transfer film 46 to nip with the platen roller 45 and thermal head 40, controls heating of the thermal head 40 based on image data to print with a head control IC (not shown), and thereby performs first transfer operation. In starting printing, based on detection signals from the sensors Se1 and Se2, the printing apparatus 1 controls driving of the wind-up spool 44 and film transfer roller 49, and aligns the beginning of the region to transfer of the transfer film 46 and the beginning of the C panel of the ink ribbon 41 in the printing position. Then, from the alignment state, the printing apparatus 1 controls wind-up operation due to the wind-up spool 44 and rotation operation of the film transfer roller 49, while nipping the ink ribbon 41 and transfer film 46 with the thermal head 40 and platen roller 45, thereby concurrently transports the C panel of the ink ribbon 41 and the transfer film 46 corresponding to one region to perform printing with Cyan, then releases the nip, and returns the transfer film 46 corresponding to one region subjected to printing.

When the transfer film 46 is thus rewound, the beginning of one region of the returned transfer film 46 and the beginning of the M panel of the ink ribbon 41 are aligned in the printing position. Next, the printing apparatus 1 controls rotation operation of the wind-up spool 44 and film transport roller 49, nips again the ink ribbon 41 and transfer film 46 with the thermal head 40 and platen roller 45 to transport, and thereby performs printing with Magenta. Then, the apparatus 1 releases the nip, returns the transfer film 46 corresponding to one region, and performs printing with Yellow by the same operation. Then, the apparatus 1 similarly performs printing with Black, and finishes the first transfer.

After the first transfer, the printing apparatus 1 peels off the ink ribbon 41, with which printing on the transfer film 46 is finished, from the transfer film 46 with the peeling roller 25 and peeling member 28, and winds up the peeled ink ribbon 41 around the wind-up spool 44 by driving of the motor Mr1. Then, the transfer film 46 is transported to the platen roller 31 and heat roller 33 with the film transport roller 49, and the printing apparatus 1 nips the transfer film 46 with the heat roller 33 and platen roller 31 together with the card, and by heating the heat roller 33, performs second transfer of the image on the transfer film 46 to the card surface to print.

In the printing apparatus 1 with the above-mentioned configuration, in the film-shaped medium such as the ink ribbon 41 and transfer film 46, the direction of the posture in the longitudinal direction and the direction of being transported coincide with each other accurately immediately after being taken out of the supply spool 43 (47), and when the reciprocating shift is repeated by winding and rewinding between the wind-up spool 44 (48) and the supply spool 43 (47), since the film-shaped medium is wound around the wind-up spool 44 (48) in a nonuniform state, the medium is fed out while being inclined in rewinding and is skewed. Then, when printing is performed in the skewed state, it is not possible to print accurately.

Accordingly, in the printing apparatus 1 according to the present invention, when the film-shaped medium performs reciprocating shifts the predetermined number of times or more, the apparatus 1 performs wind-up operation by assuming that even a region unused in printing is used, and is intended not to use a skewed portion in printing. This operation will specifically be described below in the case of the ink ribbon 41.

FIG. 3 illustrates an operation example, with a matrix, in the case of winding up even a region unused in printing not to use when the region reciprocates and shifts the predetermined number of times or more. FIG. 3 shows the number of times (hereinafter, referred to as "the number of feeding times") each region of regions 1 to 15 of the ink ribbon 41 reciprocates and shifts by rewinding and subsequent winding up when initialization (initial) and printing is performed in the order of No. 1 to No. 9. In this case, the printing apparatus 1 sets four regions closed to the printing position for monitor regions, and detects the number of feeding times thereof. Accordingly, at the operation time of No. 1, the monitor region is set on each region of the region 1 located in the printing position and regions 2 to 4 subsequent to the region 1 sequentially. In addition, in this example, monitor regions are set on four regions, and the monitor region may be a single region located in the printing position.

Then, although not shown, the printing apparatus 1 is provided with four kinds of counters that respectively store the numbers of feeding times of the monitor regions, detects the reciprocating shift of the monitor region by the sensor Se1 detecting the detection mark, and for each detection, adds "1" to the above-mentioned counter to detect the number of feeding times. Accordingly, these four kinds of counters constitute the detection section that detects the number of feeding times the monitor region unused in printing, which is located in a predetermined printing position between the supply spool 43 and the wind-up spool 44, reciprocates and shifts between the spools 43 and 44.

Figure 5:
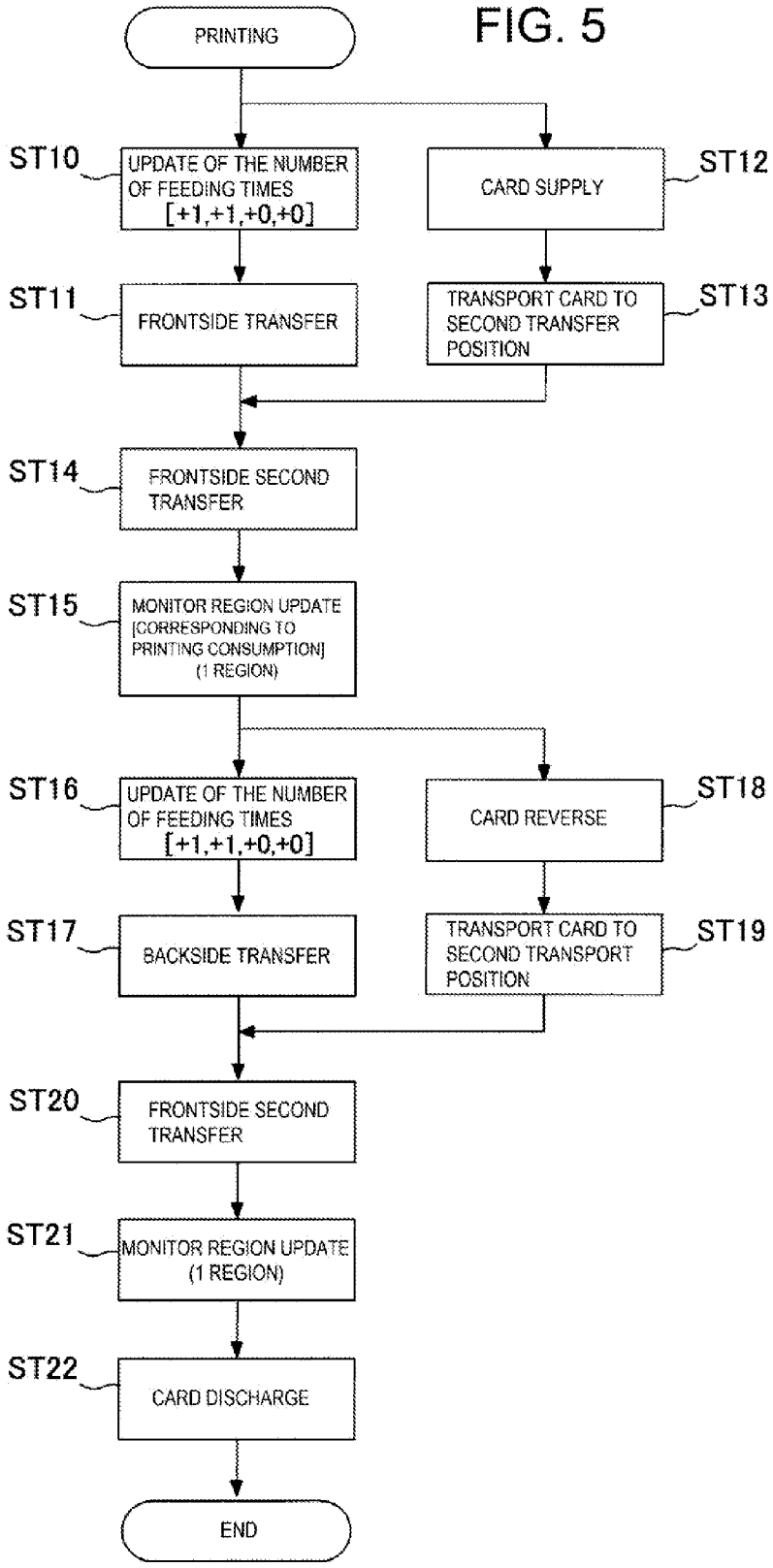
FIG. 5 shows a flowchart in printing operation of the printing apparatus.

FIG. 4 shows a flowchart in initializing the printing apparatus 1, FIG. 5 shows a flowchart in printing operation of the printing apparatus 1, and operation of the printing apparatus 1 will be described using FIGS. 3 to 5.

Herein, at this point of time, each ink of C, M, Y, K applied to each region of regions 1 to 15 is not used, each region of regions 1 to 4 is the monitor region as described previously, and the detection mark 30 of the C panel of the region 1 is fed in the printing position with the platen roller 45 and thermal head 40. Then, count values of four regions that are monitor regions at this point are all "0" and "0000" shown by an initial value of FIG. 3. When the printing apparatus 1 is instructed to perform initialization by power-on, replacement of the ink ribbon 40, check, reset switch operation or the like in this state, initialization of No. 1 is performed, and the apparatus 1 performs processing of step ST1 in FIG. 4.

In step ST1, the printing apparatus 1 determines the presence or absence of the region with the number of feeding times of three or more by operation of the initialization. In other words, the apparatus 1 determines the presence or absence of the counter that already counts "2" as a counter value among four kinds of counters. In this case, since the counter values of all of the counters are "0", the determination is "NO", and the apparatus 1 performs processing of step ST2.

Then, in step ST2, since there is no region to wind up with the ink unused, the apparatus 1 judges that "consumed region number determination: 0 region" and performs processing of next step ST3.

In initializing the ink ribbon 41, the printing apparatus 1 performs the reciprocating shift on a distance corresponding to three regions of the ink ribbon 41 by winding and rewinding, and therefore, in the processing of step ST3, adds "1" to each region of regions 1 to 3 to perform addition of the number of feeding times, while keeping the region 4 at "0".

Then, when the printing apparatus 1 performs processing of step ST6 from step ST3, since there is no region to wind up with the ink unused, the apparatus 1 performs processing of step ST7 without any operation, and initializes the ink ribbon 41. In this operation, after winding up the ink ribbon 41 corresponding to three regions, by subsequently performing rewinding to shift the same three regions in an opposite direction, feeding of the ink ribbon 41 and correction of a sag is performed, and during this time, for example, the apparatus 1 detects a remaining amount, ribbon diameter, type and the like of the ink ribbon from the feeding velocity of the ink ribbon 41. Then, in processing of next step ST8, by winding and rewinding also the transfer film 46, as in the ink ribbon 41, the apparatus 1 performs feeding of the transfer film 46, correction of a sag, and detection of a remaining amount, transfer film diameter, type and the like.

Then, in processing of step ST9, the printing apparatus 1 updates the monitor regions, while not changing the monitor regions until this operation, and in ending the initialization, count values of respective regions of regions 1 to 4 are "1110".

When the printing apparatus 1 is next instructed to perform initialization also (No. 2 in FIG. 3), the apparatus 1 performs processing of the flowchart in FIG. 4, and since the count value is "3" or less also in this case, repeats the processing from step ST2. However, since this case is the second initialization, count values of respective regions of regions 1 to 4 are updated to "2220" in ending the initialization.

When the printing apparatus 1 is further instructed to perform initialization successively (No. 3 in FIG. 3), since count values of respective regions of regions 1 to 3 at this point are "222", the apparatus 1 judges that the initialization is the third successive feeding operation and performs processing of step ST4. Then, in step ST4, the printing apparatus 1 winds up these three regions with the ink unused after the third successive feeding operation, thereby judges that "consumed region number determination: 3 regions", and performs processing of step ST5.

In the processing of step ST5, the printing apparatus 1 adds "1" to all of the regions 1 to 4 to perform addition of the number of feeding times, and respective count values of the regions 1 to 4 are "3331" (No. 3 "Initialization start" in FIG. 3).

In processing of step ST6, since the regions with the counter value of "3" exist, the printing apparatus 1 winds up the ink ribbon 41 corresponding to three regions. By this means, the regions 1 to 3 are wound up with the ink unused and undergo used (consumed) processing, and the region 4 is newly set at the beginning of the printing position. Then, the printing apparatus 1 performs the above-mentioned processing of steps ST7 and ST8, and in the processing of step ST9, since the count values of the regions 1 to 3 are "3" among four monitor regions, sets regions of regions 4 to 7 for new monitor regions to update the monitor regions. Accordingly, at this point of time, count values are "1000" in four types of counters that respectively store numeric values of four regions as the monitor regions.

Up to herein, the operation in the case where initialization is performed three times successively is described, and operation will be described when the operation is printing operation subsequently thereto (No. 4 in FIG. 3).

At the time of starting the printing operation, the region 4 of the ink ribbon 41 is in the printing position, and in processing of step ST10, the apparatus 1 adds "1" to each region of regions 4 and 5 to update the number of feeding times. At this point, each region of regions 6 and 7 is still "0". Accordingly, count values of respective regions of regions 4 to 7 are "2100" (No. 4 "Printing start" in FIG. 3).

In processing of step ST11, the printing apparatus 1 transfers an image to print on a surface of a card to the transfer film 46 with the thermal head 40. On the other hand, in parallel with the first transfer, the printing apparatus 1 supplies the card to print in step ST12, and in step ST13, transports the card to a second transfer position with the heat roller 33 and platen roller 31. Then, in step ST14, the apparatus 1 second transfers the image first transferred to the transfer film 46 to the card.

By this printing operation, since the region 4 of the ink ribbon 41 is consumed in the first transfer to the transfer film 46 and is wound around the wind-up spool 44, in step ST15, the apparatus 1 removes the region 4 from the monitor regions, adds the region 8 to the monitor regions, and thereby performs processing of monitor region update. By this means, count values of respective regions of regions 5 to 8 are "1000" (No. 4 "Printing end" in FIG. 3).

Further, the printing apparatus 1 is also capable of printing on the backside of the same card, and the flowchart in FIG. 5 illustrates operation in two-sided printing. In two-sided printing, the printing apparatus 1 adds "1" to each of regions 5 and 6 in step ST16, and transfers an image to print on the backside of the card to the transfer film 46 with the thermal head 40 in step ST17. At the same time, in step ST18, the apparatus 1 returns the card with printing on the frontside finished to the reverse unit F, transports the card to a second transfer position by rotating the reverse unit F 180°, and in step ST20, second transfers the image first transferred to the transfer film 46 to the card. Then, after performing processing of monitor region update in step ST21, the apparatus 1 guides the card to the storage section D, and finishes the printing operation.

The printing operation of No. 4 in FIG. 3 shows the count status of the counter of each of regions as the monitor regions in the case of performing printing on one surface of the card. Accordingly, the region 5 is positioned at the beginning of the printing position, and as described previously, count values of respective regions of regions 5 to 8 are "1000".

When the printing apparatus 1 is instructed to perform initialization in this state (No. 5 in FIG. 3), the apparatus 1 performs the processing of the flowchart in FIG. 2 as described previously. In the processing of ST1 herein, since count values of four types of counters are "1000", the apparatus 1 determines that any region of three times or more does not exist, and proceeds to step ST2. Then, in step ST2 the apparatus 1 judges that "consumed region number determination: 0 region", and by the processing of next step ST3, adds "1" to each region of regions 5 to 7 to perform addition of the number of feeding times. Accordingly, respective count values of the regions 5 to 8 are "2110".

Then, when the printing apparatus 1 performs the processing of step ST6 from step ST3, since there is no region to wind up with the ink unused, the apparatus 1 performs the processing of step ST7 without any operation, and as described previously, performs predetermined initialization during a period of performing winding and rewinding of the ink ribbon 41 corresponding to three regions successively. In the processing of next step ST9, the apparatus 1 does not update the monitor regions, and regions of the regions 5 to 8 are continuously the monitor regions.

When the printing apparatus 1 is next instructed to perform initialization also (No. 6 in FIG. 3), in the processing of step ST1 at this point, four types of count values are "2110", and in this initialization, since the region 5 undergoes the third feeding time, the apparatus 1 performs the processing of step ST4. In the processing of step ST4 at this point, since the number of feeding times is "3" in the region 5, the apparatus 1 judges that "consumed region number determination: 3 regions", and performs the processing of step ST5.

In the processing of step ST5, the printing apparatus 1 adds "1" to all of the regions 5 to 8 to perform addition of the number of feeding times. Accordingly, respective count values of the regions 5 to 8 are "3221" ("Initialization start" of No. 6 in FIG. 3).

Then, in the processing of step ST6, in this case, since the region with the counter value of "3" exists, the printing apparatus 1 winds up three regions of the regions 5 to 7 with the ink unused around the wind-up spool 44 to consume. By this means, the region 8 is set in the printing position. Then, the printing apparatus 1 performs the processing of steps ST7 and ST8, and in the processing of next step ST9, removes the wound regions 5 to 7 from the monitor regions to update the monitor regions to regions 8 to 11. By this means, count values of respective regions of the regions 8 to 11 are "1000" ("Initialization end" of No. 6 in FIG. 3).

When the printing apparatus 1 is further instructed to perform initialization successively (No. 7 in FIG. 3), in this case, since any region does not exist which undergoes the third feeding time by the initialization, the apparatus 1 determines that "consumed region number determination: 0 region" in step ST2, and in next step ST3, adds "1" to each region of the regions 8 to 11 to perform addition of the number of feeding times. Accordingly, count values of respective regions of the regions 8 to 11 are "2110" ("Initialization start" of No. 7 in FIG. 3). Then, since any region does not exist which undergoes the third feeding time by the initialization, the apparatus 1 does not update the monitor regions in step ST9, and respective count values of the regions 8 to 11 are still "2110" (Initialization end" of No. 7 in FIG. 3).

When operation is the printing operation herein, at this point of time, since the region 8 of the ink ribbon 41 is in the printing position, in the processing of step ST10, the printing apparatus 1 adds "1" to each of the regions 8 and 9 to update the number of feeding times. At this point, the regions 10 and 11 are still "1" and "0" respectively. Accordingly, count values of respective regions of the regions 8 to 11 are "3210" (No. 8 "Printing start" in FIG. 3).

For the printing operation, since the above-mentioned operation is repeated, the description of steps ST10 to ST14 is omitted, and by the printing operation, the region 8 of the ink ribbon 41 is consumed in first transfer to the transfer film 46 and is wound around the wind-up spool 44. Therefore, in the processing of step ST15, the apparatus 1 removes the region 8 from the monitor regions, adds the region 12 to the monitor regions, and thereby performs the processing of monitor region update. By this means, count values of respective regions of regions 9 to 12 are "2100" (No. 8 "Printing end" in FIG. 3). In addition, FIG. 3 illustrates count statuses of the counter of each of regions as the monitor regions in this case, assuming that printing is performed on one surface of the card also in the printing operation of No. 8.

When the apparatus 1 is instructed to perform initialization after finishing printing (No. 9 in FIG. 3), in the processing of step ST1 herein, since count values of four types of counters are "2100", the region 9 undergoes the third feeding time by the initialization, and in step ST4, the apparatus 1 judges that "consumed region number determination: 3 regions", and performs the processing of step ST5.

In the processing of step ST5, the printing apparatus 1 adds "1" to all of the regions 9 to 12 to perform addition of the number of feeding times. Accordingly, respective count values of the regions 9 to 12 are "3221" ("Initialization start" of No. 9 in FIG. 3).

Then, in the processing of next step ST6, in this case, since the region with the counter value of "3" exists, the printing apparatus 1 winds up the regions 9 to 11 with the ink unused around the wind-up spool 44 to consume. By this means, the region 12 is newly set at the beginning of the printing position. Then, the printing apparatus 1 performs the processing of steps ST7 and ST8, and in the processing of next step ST9, removes the regions 9 to 11 consumed by wind-up from the monitor regions to update the monitor regions to regions 12 to 15. By this means, count values of respective regions of the regions 12 to 15 are "1000" ("Initialization end" of No. 9 in FIG. 3).

As described specifically above, the printing apparatus 1 according to the present invention sets monitor targets on the region at the beginning of the ink ribbon 41 located in the printing position and three regions sequentially continued thereto, detects the number of feeding times for each of the monitor regions with the counters, and when the number of feeding times by reciprocating shifts due to rewinding in initialization reaches the predetermined number ("3", in this example), performs operation for winding up the ink ribbon 41 around the wind-up spool 44 with the region being a region used in printing. By this means, it is possible to prevent the printing quality from degrading because of not using portions in printing where the posture in the shift is significantly deviated from the straight-travel direction due to repetition of the number of feeding times by reciprocating shifts by winding and rewinding.

At this point, only the region with the number of feeding times reaching "3" may be wound up as the used region, but as shown in "Initialization end" of No. 6 in FIG. 3, the region reaching three times and two subsequent regions that do not reach three times are concurrently wound up. Thus, when there is a region with the number of feeding times reaching "3", even in the case where regions subsequent to the region do not reach three times, by winding up at least one or more regions together with the region reaching three times, since the distance by which the ink ribbon 41 shifts is longer corresponding thereto, the skew is corrected.

The above-mentioned description is given using the ink ribbon 41, the case of the transfer film 46 is the same, and when reciprocating shifts of winding and rewinding repeat the predetermined number of times in initialization, by winding up even an unused region without an image being transferred, it is possible to prevent the printing quality from degrading because of not using the portion in printing where the posture in the shift is significantly deviated from the straight-travel direction.

Further, this Embodiment shows the aspect where the detection mark 30 for feeding is formed for each color (panel) of the ink ribbon 41, and an encoder that detects the rotation amount of the supply spool 43 may be provided so that the sensor Se1 detects the K (Black) panel of the ink ribbon to perform feeding of each color of the ink ribbon 41 based on the rotation amount of the supply spool 43 therefrom. Further, this Embodiment shows the example where the mark is formed on the transfer film 46, and a mark may be formed using the K panel of the ink ribbon 41 before forming an image on the transfer film 46.

In addition, this application claims priority from Japanese Patent Application No. 2014-106902 incorporated herein by reference.

The invention claimed is:

1. A printing apparatus that performs printing using a film-shaped medium formed in the shape of a roll where regions used in printing on a single recording medium are continued in a longitudinal direction, comprising:

a supply section around which a portion of a printing unused region of the film-shaped medium is wound;

a wind-up section around which a portion of a printing used region of the film-shaped medium is wound; and a detection section that detects the number of feeding times that the printing unused region located in a predetermined position between the supply section and the wind-up section reciprocates and shifts between the supply section and the wind-up section, wherein when the number of feeding times reaches a predetermined number, the wind-up section is driven to shift the printing unused region in a wind-up direction from the printing position.

2. The printing apparatus according to claim 1, wherein when reciprocating shifts of the printing unused region reach the predetermined number of times, the region and at least one of the regions continued to the region on the supply section side are shifted concurrently in the wind-up direction.

3. The printing apparatus according to claim 1, wherein a monitor region is set on the printing unused region located in the printing position and at least one of the regions or more continued to the region on the supply section side, and the monitor region, where it is detected by the detection section that the number of feeding times reaches the predetermined number, is shifted in the wind-up direction.

4. The printing apparatus according to claim 3, wherein when the detection section detects that the number of feeding times of the monitor region located in the printing position reaches the predetermined number, a beforehand determined number of monitor regions continued to the monitor region are shifted in the wind-up direction irrespective of whether or not the number of feeding times of each of the regions reaches the predetermined number.

5. The printing apparatus according to claim 1, wherein the film-shaped medium is an ink ribbon coated with ink used in printing on a single recording medium for each region.

6. The printing apparatus according to claim 1, wherein the film-shaped medium is a transfer film to print an image on a single recording medium after printing the image on the region with ink applied to the ink ribbon.

* * * * *